US009375744B2

(12) United States Patent
Alexander et al.

(10) Patent No.: US 9,375,744 B2
(45) Date of Patent: Jun. 28, 2016

(54) VEHICLE HOOD FIXTURE

(71) Applicant: HONDA MOTOR CO., LTD., Tokyo (JP)

(72) Inventors: William Alexander, Greensburg, IN (US); Eric Vanderpool, Batesville, IN (US)

(73) Assignee: HONDA MOTOR CO., LTD., Tokyo (JP)

( * ) Notice: Subject to any disclaimer, the term of this patent is extended or adjusted under 35 U.S.C. 154(b) by 92 days.

(21) Appl. No.: 14/535,965

(22) Filed: Nov. 7, 2014

(65) Prior Publication Data

US 2016/0129465 A1 May 12, 2016

(51) Int. Cl.
*B05B 13/02* (2006.01)
*B05D 1/18* (2006.01)

(52) U.S. Cl.
CPC ..... *B05B 13/0285* (2013.01); *B05D 1/18* (2013.01)

(58) Field of Classification Search
CPC ..... B23Q 3/103; B23Q 3/154; B23Q 7/1431
See application file for complete search history.

(56) References Cited

U.S. PATENT DOCUMENTS

| | | | | |
|---|---|---|---|---|
| 3,486,481 | A | 12/1969 | Herrinton et al. | |
| 5,458,447 | A * | 10/1995 | Clason | B60P 7/135 410/100 |
| 5,653,805 | A | 8/1997 | Russell et al. | |
| 7,410,142 | B2 | 8/2008 | Kurtz et al. | |
| 8,239,063 | B2 | 8/2012 | Clifford et al. | |
| 2003/0213113 | A1 * | 11/2003 | McMillan | B63B 21/502 29/281.1 |
| 2004/0238984 | A1 | 12/2004 | Beckord | |
| 2004/0244683 | A1 | 12/2004 | Beckord | |
| 2006/0086317 | A1 | 4/2006 | Fiedler | |
| 2012/0240849 | A1 | 9/2012 | Deshler | |
| 2014/0263896 | A1 * | 9/2014 | David | A47B 96/069 248/207 |

FOREIGN PATENT DOCUMENTS

| | | | |
|---|---|---|---|
| DE | 203 11 091 | U1 | 11/2003 |
| DE | 10 2010 050 625 | A1 | 5/2015 |
| FR | 2 898 944 | A1 | 9/2007 |
| JP | 2005-199982 | A | 7/2005 |
| KR | 0173654 | | 10/1988 |

* cited by examiner

*Primary Examiner* — Lee D Wilson
(74) *Attorney, Agent, or Firm* — Kenealy Vaidya LLP

(57) ABSTRACT

A temporary supporting fixture for use during painting of a vehicle hood. The fixture has a first elongated beam with a first length and includes at least two adjustable length hook members extending from an engagement side for releasable attachment to the hood. A second elongated beam having a second length greater than the first length is also provided and includes at least two hook elements extending from the engagement side of the fixture and configured for releasable attachment to the hood. The second elongated beam further includes at least two adjustable extensions protruding from the engagement side of the fixture and configured for engagement with a surface of the hood. The second beam further includes an at least generally tangential projection configured to engage a striker of the hood. At least two struts extend between the first and second elongated beams. An extension beam including an adjustable length hook member configured for releasable attachment to the hood extends from the first elongated beam in a direction away from the second elongated beam.

21 Claims, 5 Drawing Sheets

VEHICLE HOOD FIXTURE

BACKGROUND

The present disclosure generally relates to a fixture suitable for use with a vehicle hood during the process of applying a coating, such as paint and/or primer. It is to be appreciated that the present exemplary embodiment is also amenable to other like applications that encounter similar problems or require similar solutions.

Automobile production lines include a location where an automobile body and various body panels such as doors, engine hood, trunk lid, roof, etc. are painted or otherwise coated. Body parts may be coated separately, wherein the body panel and the automobile body use separate feed paths or may be coated while attached to the automobile body.

In one example, during the first stage of a painting process, the entire vehicle body including the hood is coated with a primer during what is known as an E-coat process. The temperature of the E-coat bath is relatively high, usually in the range of about 325° to 450° F. During the E-coat process, the hood may be detached from the vehicle body or the hood may be attached to the vehicle body but in a partially open position. In either scenario, the extreme heat of the E-coat oven and the bending stress resulting from a lack of vehicle body support can warp the hood panel.

As the vehicle body passes through the base and clear coat stages of the painting process, the warping which occurs during the E-coat process is enhanced by the continued stress on the hood panel and may become a visible coating defect after the smooth and glossy paint finish has been applied. The warping may also cause misalignment between the hood and the vehicle body structure.

The present disclosure provides a fixture which controls the shape of the hood (also referred to as a bonnet) by locking it in place during the E-coat process and optionally during subsequent painting procedures. The fixture controls the flushness and symmetry of the hood and does not allow it to change shape.

BRIEF DESCRIPTION

Various details of the present disclosure are hereinafter summarized to provide a basic understanding. This summary is not an extensive overview of the disclosure, and is intended neither to identify certain elements of the disclosure, nor to delineate the scope thereof. Rather, the primary purpose of this summary is to present some concepts of the disclosure in a simplified form prior to the more detailed description that is presented hereinafter.

According to a first embodiment, a temporary supporting fixture for painting an associated hood of a vehicle is provided. The fixture includes a first elongated beam having a first length and at least two hook members extending from an engagement side. The hook members are configured for releasable attachment to the hood. A second elongated beam having a second length greater than the first length is also provided. The second beam includes at least two hook elements extending from the engagement side and configured for releasable attachment to the hood. The second elongated beam further includes at least two adjustable extensions protruding from the engagement side of the fixture and configured for engagement with a surface of the hood. At least one strut extends between the first and second elongated beams.

According to a second embodiment, a method of painting a vehicle is provided. The method includes the step of attaching the above-described fixture to a vehicle, wherein each hook element is secured in a drain hole formed in the hood to control both the symmetry and flushness of the hood and a coating is applied.

According to a further embodiment, a temporary supporting fixture for painting an associated hood of a vehicle is provided. The fixture has a first elongated beam with a first length and includes at least two adjustable length hook members extending from an engagement side. The hook members are configured for releasable attachment to the hood. A second elongated beam having a second length greater than the first length is also provided. The second beam includes at least two hook elements extending from the engagement side of the fixture and configured for releasable attachment to the hood. The second elongated beam further includes at least two adjustable extensions protruding from the engagement side of the fixture and configured for engagement with a surface of the hood. The second beam further includes an at least generally tangential projection configured to engage a striker of the hood. At least two struts extend between the first and second elongated beams. An extension beam including an adjustable length hook member configured for releasable attachment to said hood extends from the first elongated beam in a direction away from the second elongated beam.

BRIEF DESCRIPTION OF THE DRAWINGS

The following description and drawings set forth certain illustrative embodiments of the disclosure in detail, which are indicative of several exemplary ways in which the various principles of the disclosure may be carried out. The illustrated examples, however, are not exhaustive of the many possible embodiments of the disclosure. Other objects, advantages and novel features of the disclosure will be set forth in the following detailed description of the disclosure when considered in conjunction with the drawings, in which.

DETAILED DESCRIPTION

Figure 1:
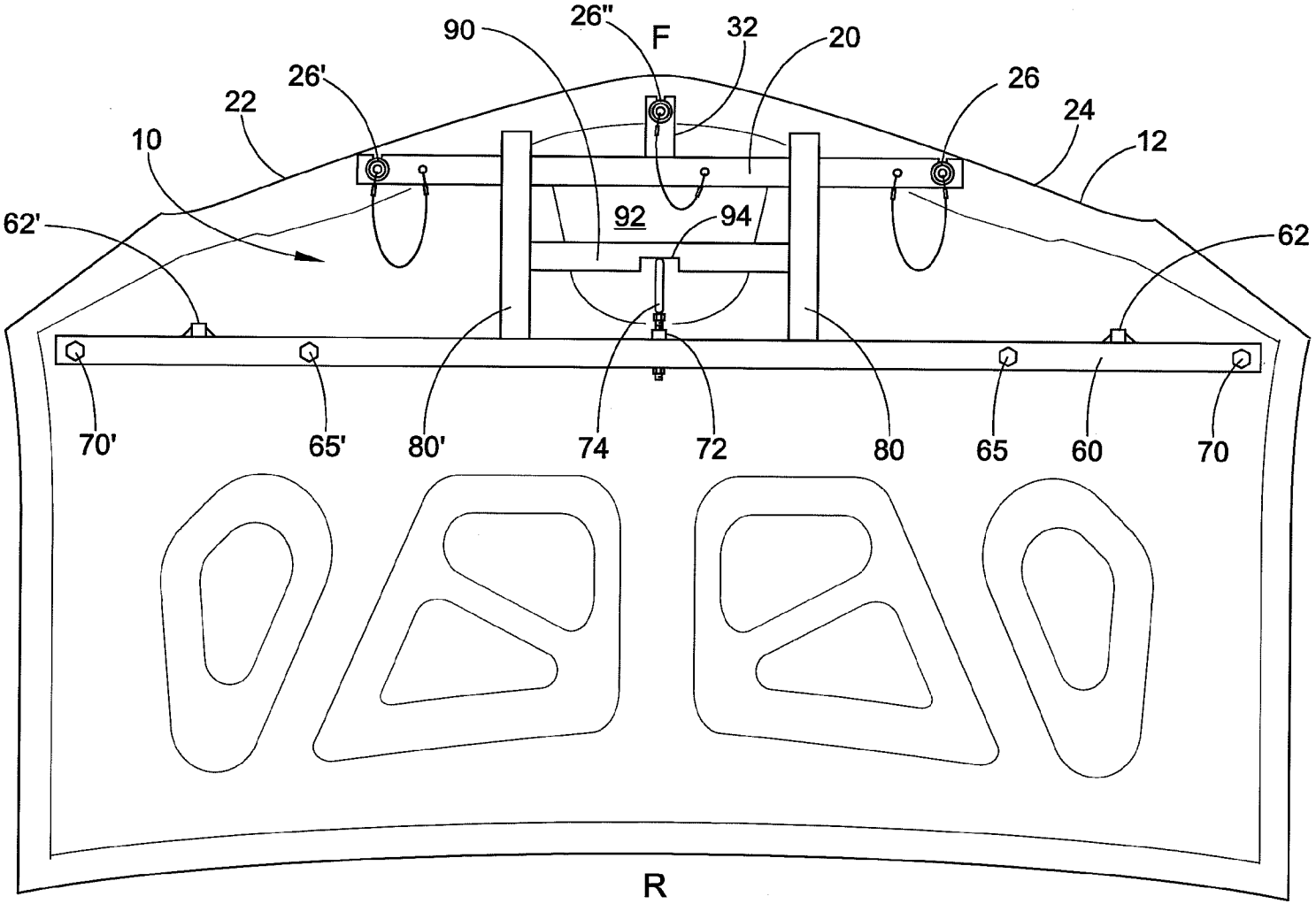
FIG. 1 is a top plan view of an exemplary fixture secured to a vehicle hood.
Figure 2:
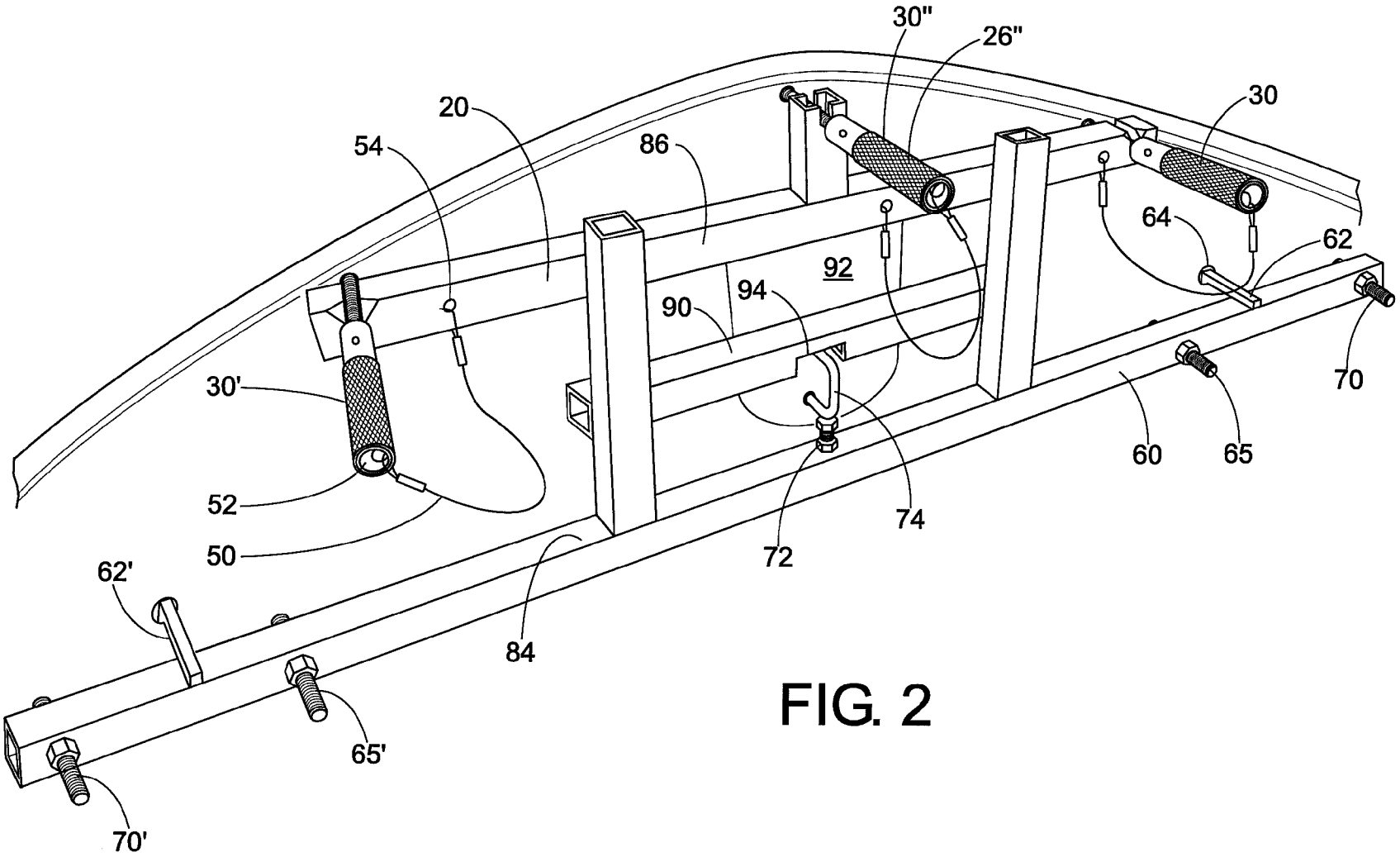
FIG. 2 is a perspective view of the fixture of FIG. 1.
Figure 3:
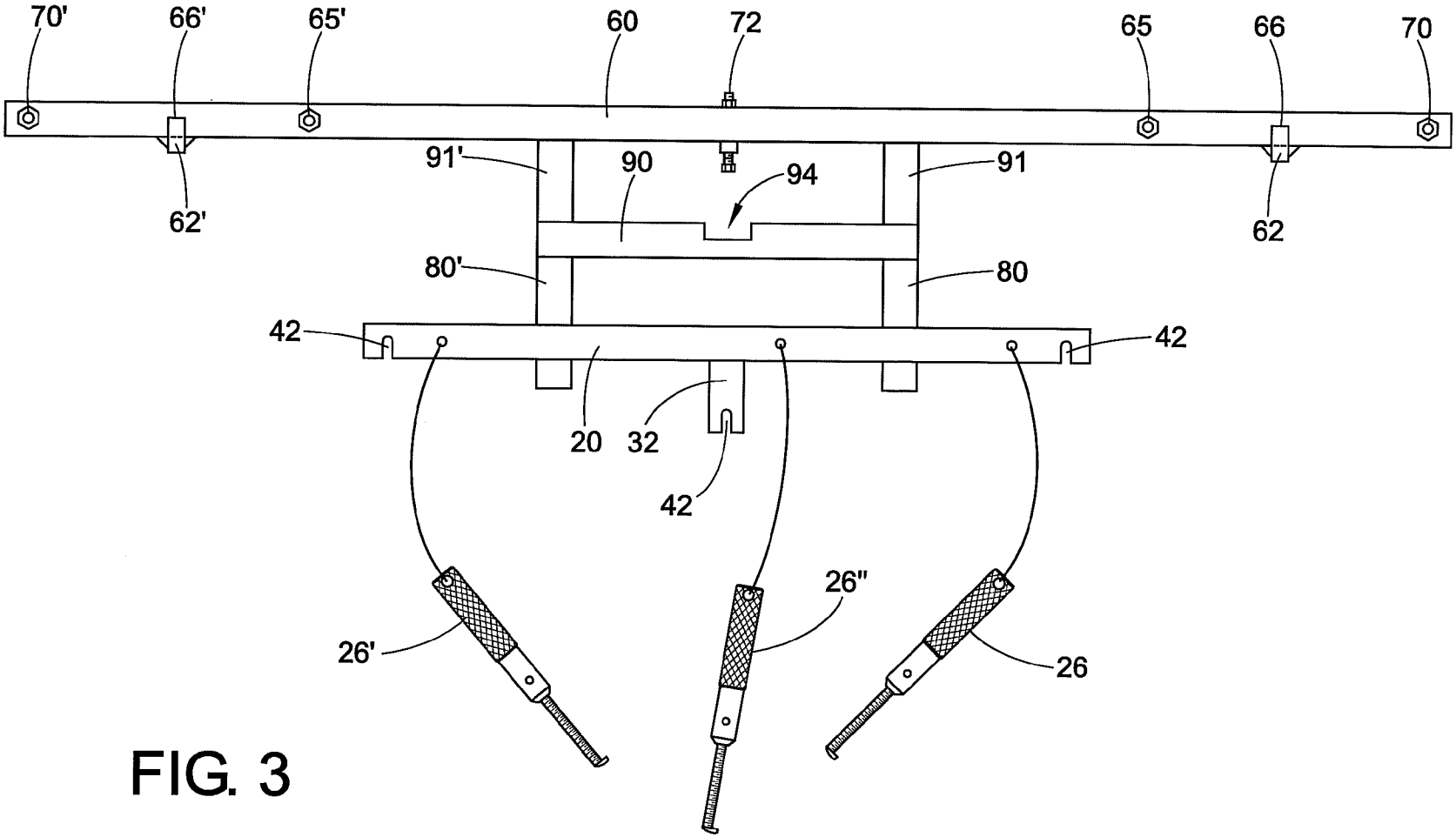
FIG. 3 is a top plan view of the fixture of FIG. 1 removed from the vehicle hood.

The description and drawings herein are merely illustrative. Various modifications and changes can be made in the structures disclosed without departing from what is defined in the appended claims. All references to direction and position, unless otherwise indicated, refer to the orientation of the structures and components illustrated in the drawings and should not be construed as limiting the claims appended hereto. Like numbers refer to like parts throughout the several views.

Referring in detail to the drawings, FIGS. 1-6 illustrate a fixture apparatus 10 for use in the manufacture of vehicles such as automobiles during the application of a coating to the vehicle hood and/or the hood as attached to the vehicle body. The fixture apparatus 10 is adapted for use on a vehicle hood 12. It is envisioned that the fixture apparatus 10 can be used with a hood constructed of metal (such as aluminum), fiberglass or other thermoplastic composite materials.

Fixture 10 has a first elongated support beam 20 of an essentially rigid construction. The first support beam 20 can span a distance laterally between forward edges 22 and 24 of the vehicle hood 12. However, it is noted that the precise positioning of beam 20 can be adjusted by the skilled practitioner. Moreover, while it may be advantageous for the beam 20 to terminate adjacent an edge of the hood, the particular point of engagement with the hood edge may be more forward (F) or more rearward (R). Adjustable length hook members 26 and 26' are secured to opposite longitudinal ends of beam 20. The hook members 26 and 26' releasably attach the beam 20 to drain holes 30 and 30' formed on the edge of hood 12.

An extension beam 32 is rigidly affixed at a longitudinal midpoint of beam 20 and extends perpendicular to the longitudinal axis of beam 20. Beam 32 can be secured to beam 20 by a method such as welding. Extension beam 32 is provided such that fixture 10 can have a peripheral shape at least generally concentric to the shape of the hood 12, particularly in the region adjacent the forward edge.

Extension beam 32 further includes a removable adjustable length hook member 26" selectively received within drain hole 30". Extension beam 32 is positioned to provide a cantilever support at about the midpoint of beam 20.

Although the adjustable length hook members are described herein as secured within drain holes, this selection is not limiting. Moreover, it is contemplated that holes not configured to provide drainage may be used. Alternatively, it is feasible that connection points such as tabs or ledges, as examples, may protrude from the surface of the hood. In short, any configuration suitable to provide purchase for the removable hook member is acceptable. Similarly, although desirable to provide flexibility and adjustability, the hook member are not necessarily adjustable or removable.

Each of the hook members 26 is preferably constructed from steel having a thickness substantial enough to prevent deformation or bending of the hook members during use. Each of the hook members 26 has a threaded hook portion 34 terminating in hook tip 35 and extending from one end of a main hook body 36. Each hook member 26 also has a length adjustment feature such as set screw 38 which can be loosened to allow adjustment of the distance threaded hook portion 34 extends from an internally threaded section of main body 36. Hook tip 35 can be sized appropriately for removable insertion into drain hole(s) 30. The end of hook member 26 opposite the hook tip 35 can include a textured surface 48 to improve gripping.

Figure 4:
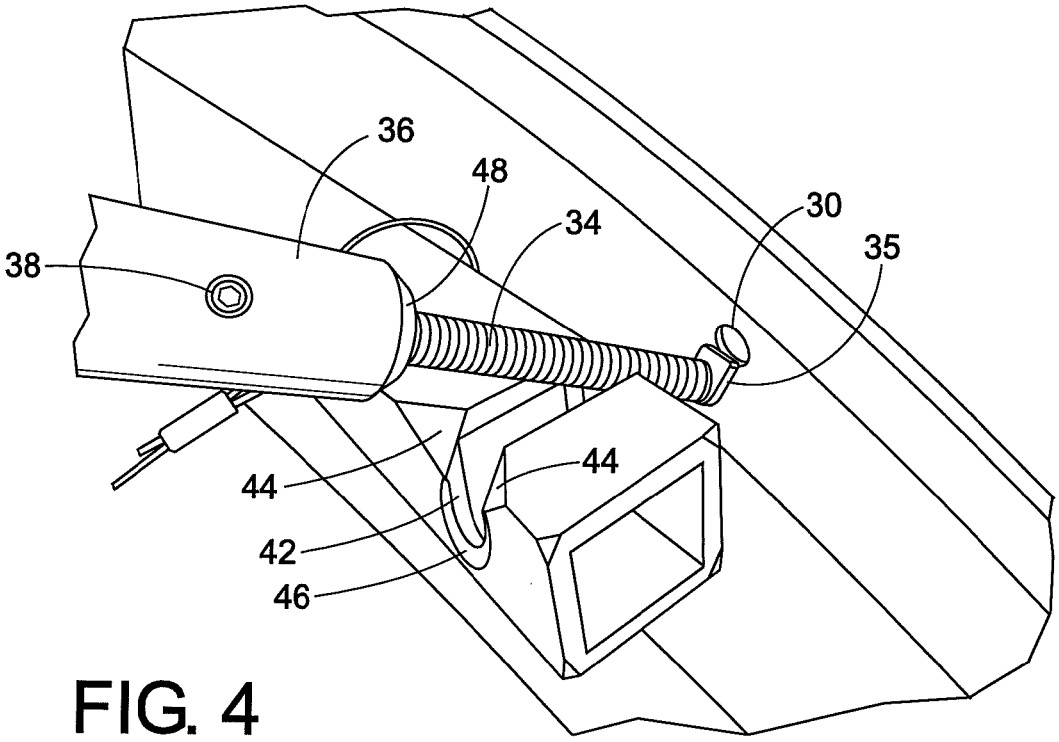
FIG. 4 is an exploded perspective view illustrating an adjustable length hook element of FIGS. 1-3 in a partially installed position.
Figure 5:
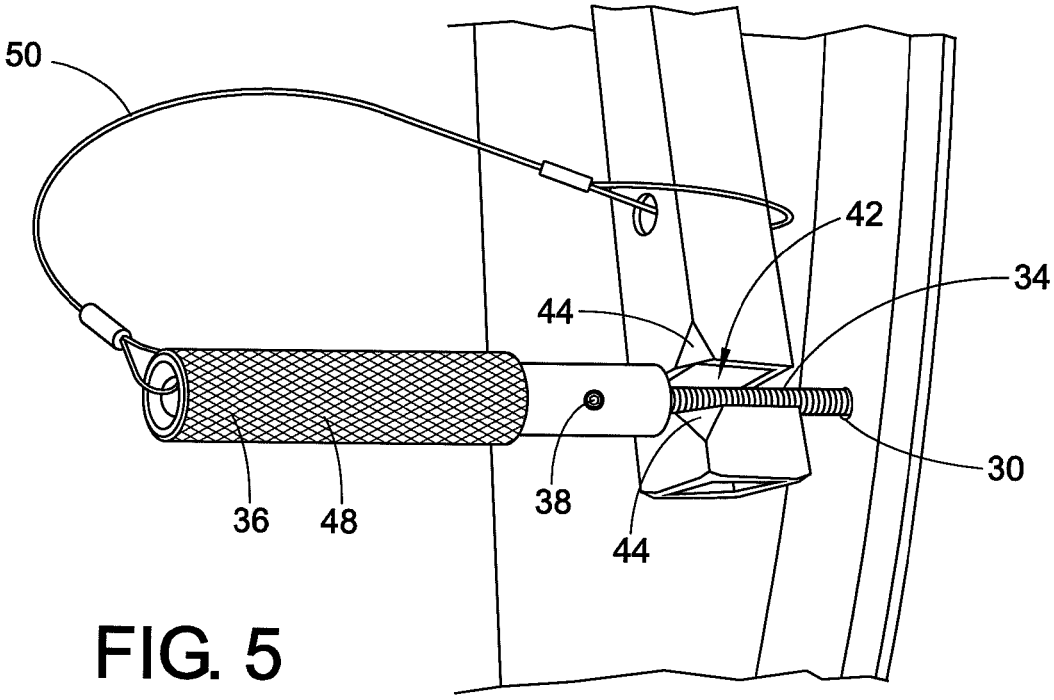
FIG. 5 illustrates the adjustable length hook member of FIG. 4 in an installed condition.
Figure 6:
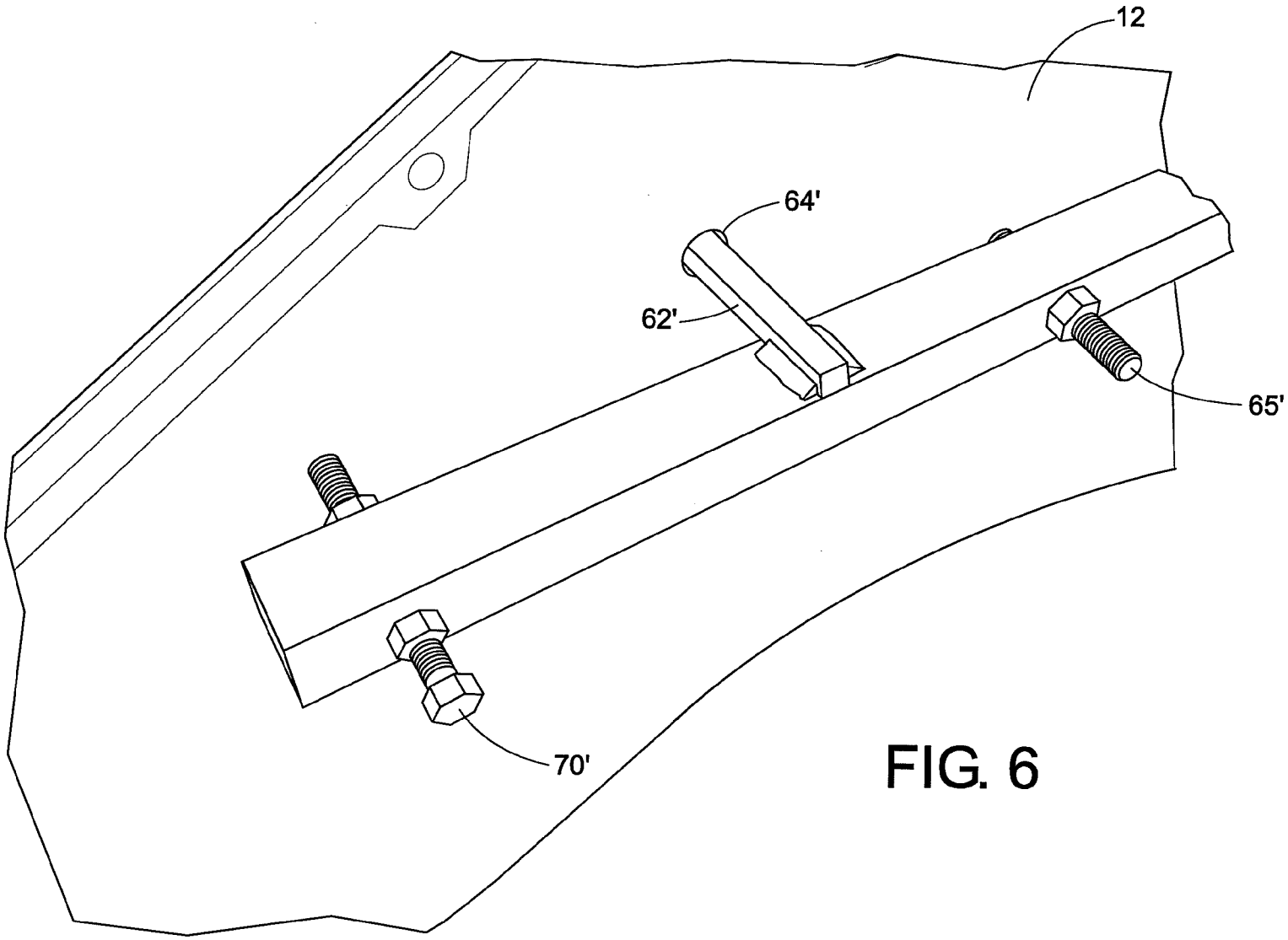
FIG. 6 is an exploded perspective view of a portion of the fixture as shown in FIGS. 1-3, illustrating one hook element and one adjustable extension of the long beam as secured to the vehicle hood.

With specific reference to FIGS. 4 and 5, hook member 26 can be received within a cutout 42 formed in beam 20. As illustrated, the cutouts 42 are sized to receive threaded hook portion 34 and extend approximately ½ of the width of the beam 20. Advantageously, each cutout can include a tapered flange 44 to prevent hook member 26 from catching during installation/detachment. Further, each cutout 42 can include a registration detent 46 shaped cooperatively with a mating surface 48 on the main body 36 of hook member 26.

Each hook member 26 can be attached to the fixture 10 by means of a tether 50. Tether 50 can have a first end secured within a passage 52 in hook member 26 and a second end secured to a hole 54 formed in a beam of the fixture, such as beam 20.

Beam 20 of the fixture 10, in conjunction with extension 32 and hook members 26, is designed to control flushness by controlling the hemline of the bonnet.

A second elongated beam 60 is preferably constructed of a rigid material. Beam 60 typically can have a length greater than beam 20 which coincides with its' intended positioning more rearward (R) on the hood 12 and at a position on the hood which is generally wider. Beam 60 can be secured to hood 12 via a pair of hook elements 62 and 62' received within holes 64 and 64'. As illustrated, hook elements 62 can be permanently attached to the beam 60, such as by welding. However, it is considered feasible to use adjustable detachable hook members as an alternative.

Tension between the fixture 10 and the hood 12 is established by adjustable bolts 70 and 70'. Particularly, adjustment of bolts 70 and 70' into engagement with hood 12 extends fixture 10 away from the hood 12 such that hook tips 66 and 66' of hook element 62 and 62' become engaged within holes 64 and 64'. In addition to creating tension, bolts 70 and 70' support the outside frame edge of the bonnet.

Beam 20 further includes a pair of bolts 65 and 65'. Bolts 65 and 65' extend from the fixture 10 in a direction opposite bolts 70 and 70'. Moreover, bolts 65 and 65' extend away from the hood 12 when the fixture 10 is attached. Bolts 65 and 65' are configured to engage the bulkhead of the vehicle during the E-coat process. In this manner, the fixture props the hood in a minor open position as the vehicle descends into the E-coat tank. As the vehicle becomes submerged in the tank, the hood is free to float upward in response to air pressure between the hood skin and the hood frame. After the vehicle is removed from the coat tank, the fixture bolts 65 and 65' re-engage the bulkhead, maintaining the hood in a minor open position for a subsequent baking step. In certain embodiments, it may be desirable to have bolts 65 and 65' that are adjustable in length. Also, it is noted that bolts 65 and 65' could readily be situated at other locations on fixture 10.

Beam 60 further includes a centrally located lateral engagement bolt 72. Bolt 72 is adjustable lengthwise to allow engagement with a striker element 74 disposed on hood 12. In this manner, lateral stability is provided when the fixture 10 is fully attached to the hood 12. To take full advantage of the lateral engagement bolt 72, it may be desirable for hook tips 35 and 66 to be oriented facing rearward (R) such that bolt 72 urges overlap of the tips with the material of the hood forming the respective hole into which each is inserted.

A pair of struts 80 and 80' can be welded to a sidewall 84 of beam 60. Struts 80 extend forward (F) from beam 60 and are each welded to a base wall 86 of beam 20. In this manner, beam 20 can be disposed in a plane relatively higher (using the hood as a reference for upward) than beam 60. This configuration represents the general curvature of a common hood design in present day vehicles. Nonetheless, this disclosure contemplates any arrangement of the beams, including adding curvature thereto, which may be necessary to provide a fixture having a contour generally matching the curvature of the associated hood.

A cross-bar 90 can be provided between struts 80 and 80'. The cross-bar is located between beams 20 and 60 and can run generally parallel thereto. The cross-bar 90 can be welded to the upper surfaces 91 and 91' of the struts 80 and 80' so that cross-bar 90 rests against the striker plate 92 (or components thereof such as nuts or bolt heads) to give leverage to the three hook members 26 located in the drain holes 30. Cross-bar 90 may include a cut-out 94 oriented to receive the striker 74 when the fixture 10 is installed on the hood.

The beams and cross-bar of the present fixture can be constructed of steel. An exemplary material is HSS-shape structural steel. However, it is noted that the specific shape and/or orientation of the beams, struts, and extensions of the subject fixture can be arranged based on the shape and contour of the hood with which it is being associated. In this regard, the configuration and construction of the beams and hook elements/members may take on any number of configurations to accommodate any particular vehicle hood shape, construction, and configuration without departing from the scope of the disclosure.

To prepare fixture 10 for installation to hood 12, hook members 26 can be removed from notches 44. Fixture 10 can be first associated with hood 12 by inserting hook elements 62 into the associated holes 64. Bolts 70 can be extended into engagement with the hood 12. Hook members 26 can be inserted into the associated holes 30, pulled away from the hood 12, and cammed into position in notches 44. As necessary, the length of threaded hook portion can be adjusted to reflect changes in the shape of fixture 10 over time. Thereafter, engagement bolt 72 can be extended into engagement with striker 74. When set in place and locked down, the aluminum bonnet cannot change shape and is held to the shape to which it was designed. By controlling the shape of the vehicle bonnet through the E-coating process, symmetry and flushness are improved, resulting in reduced cost associated with repair.

The first step of the paint application process for a typical automotive vehicle body is to immerse the entire body in an E-coat primer bath. In association with the present fixture, this may be performed with the hood installed on the vehicle or separately from the vehicle. If the E-coating is performed with the hood attached to the vehicle, the hood may be secured in an open position at an angle relative to the remainder of the vehicle body or to horizontal. This is to ensure that the E-coat primer covers virtually the entire bare metal surface of the hood, and yet to ensure proper flow and coverage of the primer on the hood outer surface. Fixture 10 could be designed to include a mechanism which positions the hood at a predetermined angle relative to the vehicle body.

Typically, the next stage of the paint application process involves adding the base color, and, if necessary, clear coat paint. It is envisioned that the present fixture can be used similarly, but not necessarily for such subsequent steps.

This written description uses examples to describe the disclosure, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

What is claimed is:

1. A temporary supporting fixture for painting an associated hood of a vehicle, said fixture comprising:

a first elongated beam having a first length and including at least two hook members extending from an engagement side of the fixture, said hook members configured for releasable attachment to said hood;

a second elongated beam having a second length greater than the first length and including at least two hook elements extending from the engagement side of the fixture and configured for releasable attachment to said hood, the second elongated beam further including at least two adjustable extensions protruding from the engagement side of the fixture and configured for engagement with a surface of the hood, the second elongated beam being disposed in a generally parallel position relative to the first elongated beam; and at least one strut extending between said first and second elongated beams, the at least one strut configured to attach to a lower surface of the first elongated beam and an upper surface of the second elongated beam such that the first elongated beam is disposed in a horizontal plane that is elevated with respect to a horizontal plane of the second beam.

2. The fixture of claim 1 wherein said hook members are adjustable lengthwise.

3. The fixture of claim 1 including at least two struts.

4. The fixture of claim 1 wherein an engagement side surface said first and second elongated beams reside in different planes.

5. The fixture of claim 1 wherein said at least two hook elements are permanently attached to said second beam.

6. The fixture of claim 1 wherein said hook members are detachable from said first beam.

7. The fixture of claim 6 wherein said hook members are attached to said fixture by a tether.

8. The fixture of claim 1 further comprising an extension beam extending from the first elongated beam in a direction away from the second elongated beam, the extension beam further including a hook member configured for releasable attachment to said hood.

9. The fixture of claim 1 wherein said second elongated beam includes a projection configured to engage a striker of said hood when said fixture is attached.

10. The fixture of claim 9 wherein a length of said projection is adjustable.

11. The fixture of claim 1 wherein an imaginary center line divides a length of each elongated beam at a mid-point and wherein said fixture is symmetric about said center line.

12. The fixture of claim 3 including a cross-beam disposed between said struts and extending at least generally parallel to said first and second elongated beams, said cross-beam configured to engage a striker plate of the hood when the fixture is attached.

13. The fixture of claim 12 wherein said cross-beam includes a cut out configured to receive a striker.

14. A method of painting a vehicle comprising the steps of attaching the fixture of claim 1 to said vehicle, wherein each of said hook element is secured within a hole formed in said hood, to control both the symmetry and flushness of the hood, and applying a coating.

15. A temporary supporting fixture for painting an associated hood of a vehicle, said fixture comprising:

a first elongated beam having a first length and including at least two adjustable length hook elements, extending from an engagement side of the fixture, said hook elements configured for releasable attachment to said hood;

a second elongated beam having a second length greater than the first length and including at least two hook elements extending from the engagement side of the fixture and configured for releasable attachment to said hood, the second elongated beam further including at least two adjustable extensions protruding from the engagement side of the fixture and configured for engagement with a surface of the hood, said second beam further including an at least generally tangential projection configured to engage a striker of said hood, the second elongated beam being disposed in a generally parallel position relative to the first elongated beam;

at least two struts extending between said first and second elongated beams; and an extension beam extending from the first elongated beam in a direction away from the second elongated beam, the extension beam further including an adjustable length hook element configured for releasable attachment to said hood, each of the at least two struts configured to attach to a lower surface of the first elongated beam at a first end and attach to an upper surface of the second elongated beam at a second end, such that the first elongated beam is disposed in a horizontal plane that is elevated with respect to a horizontal plane of the second beam.

16. The fixture of claim 15 wherein said projection is adjustable lengthwise.

17. The fixture of claim 15 further comprising a cross-beam configured for engagement with a striker assembly of the hood.

18. The fixture of claim 15 wherein said adjustable extensions are located relatively closer to an end of the second elongated beam than a nearest of said hook elements.

19. The fixture of claim 15 defining a peripheral shape configured at least generally concentric to a shape of an edge defining said hood.

20. The fixture of claim 15 further including at least one post extending from a side of said fixture opposite the engagement side.

21. A fixture for controlling the shape of a vehicle body panel during the application of paint or other coating material, said fixture comprising:

a first rigid beam including at least two hook members configured for insertion into cooperative holes formed in an edge of said body panel, said hook members being removable from said first beam, said hook members further including a means for length adjustment;

a second rigid beam including at least two hook elements configured for insertion into cooperative holes formed in said body panel and at least two adjustable extensions disposed adjacent opposed ends of the second beam, the second beam being disposed in a generally parallel position relative to the first elongated beam; and at least one strut connecting said first and second beams, the at least one strut configured to attach to a lower surface of the first elongated beam and an upper surface of the second elongated beam such that the first elongated beam is disposed in a horizontal plane that is elevated with respect to a horizontal plane of the second beam.

* * * * *